US010641500B2

(12) United States Patent
Yun

(10) Patent No.: US 10,641,500 B2
(45) Date of Patent: May 5, 2020

(54) SHELF SUPPORTING APPARATUS AND COOKING APPLIANCE INCLUDING A SHELF SUPPORTING APPARATUS

(71) Applicant: LG ELECTRONICS INC., Seoul (KR)

(72) Inventor: Junho Yun, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 214 days.

(21) Appl. No.: 15/861,874

(22) Filed: Jan. 4, 2018

(65) Prior Publication Data

US 2018/0195737 A1 Jul. 12, 2018

(30) Foreign Application Priority Data

Jan. 9, 2017 (KR) ..... 10-2017-0003117

(51) Int. Cl.
*F24C 15/02* (2006.01)
*F24C 15/16* (2006.01)
(Continued)

(52) U.S. Cl.
CPC ..... *F24C 15/162* (2013.01); *E05C 17/025* (2013.01); *F24C 3/025* (2013.01); *F24C 15/028* (2013.01); *F24C 15/168* (2013.01)

(58) Field of Classification Search
CPC ..... F24C 15/16
(Continued)

(56) References Cited

U.S. PATENT DOCUMENTS 2,296,950 A * 9/1942 Roedl ..... F24C 15/162 312/269
3,016,276 A * 1/1962 Morse ..... F24C 15/162 312/274

(Continued)

FOREIGN PATENT DOCUMENTS

DE 10 2012 200 306 7/2013
JP 06-221581 8/1994

(Continued)

OTHER PUBLICATIONS

Eurpen Search Report dated May 16, 2018.
Korean Notice of Allowance dated Jun. 26, 2018.

*Primary Examiner* — Avinash A Savani
(74) *Attorney, Agent, or Firm* — KED & Associates LLP

(57) ABSTRACT

A shelf supporting apparatus and a cooking appliance including a shelf supporting apparatus are provided. The shelf supporting apparatus may include a pair of fixing frames provided to face each other on opposite sides of a chamber which is opened and closed by a door; a pair of supports provided to have a length which is changeable in a frontward-rearward direction, the pair of supports being, respectively, coupled to the pair of fixing frames and having a shelf mounted thereon; coupling members provided on the pair of fixing frames and coupling the pair of supports to the pair of fixing frames to be position-changeable in the frontward-rearward direction; and a pair of connecting members that, respectively, connects the pair of supports and the door, and changing positions of the pair of supports in the frontward-rearward direction in conjunction with a rotation of the door.

15 Claims, 11 Drawing Sheets

(51) Int. Cl.
*E05C 17/00* (2006.01)
*F24C 3/02* (2006.01)

(58) Field of Classification Search
USPC ..... 126/340
See application file for complete search history.

(56) References Cited

U.S. PATENT DOCUMENTS

| | | | | |
|---|---|---|---|---|
| 2009/0095279 | A1* | 4/2009 | Ambrose | F24C 15/16 126/337 R |
| 2010/0218755 | A1* | 9/2010 | Stewart | F24C 15/168 126/339 |
| 2010/0283364 | A1 | 11/2010 | Koehler | |

FOREIGN PATENT DOCUMENTS

| | | |
|---|---|---|
| JP | 08-010765 | 3/1996 |
| JP | 11-083041 | 3/1999 |
| WO | WO 2014/082828 | 6/2014 |

* cited by examiner

SHELF SUPPORTING APPARATUS AND COOKING APPLIANCE INCLUDING A SHELF SUPPORTING APPARATUS

CROSS-REFERENCE TO RELATED APPLICATION(S)

This application claims the priority of Korean Patent Application No. 10-2017-0003117 filed in Korea on Jan. 9, 2017, in the Korean Intellectual Property Office, the disclosure of which is hereby incorporated by reference in its entirety.

BACKGROUND

1. Field

A shelf supporting apparatus and a cooking appliance including a shelf supporting apparatus are disclosed herein.

2. Background

A cooking appliance is a kind of household appliances for cooking food or other items (hereinafter "food"), which is installed in a kitchen and is used to cook food. Such cooking appliances may be classified by a heat source, a shape, or a type of fuel.

Cooking appliances may be classified into open-type cooking appliances and closed-type cooking appliances depending on where food is placed and how the food is cooked. The closed-type cooking appliances include an oven, and a microwave oven, for example, while open-type cooking appliances include a cooktop, and a hob, for example.

A closed-type cooking appliance has a closed space where food is placed, and the food is cooked by heating the closed space. A closed-type cooking device includes a chamber in which food is placed and which is closed during cooking. The food is actually cooked in the chamber. A heat source is disposed inside or outside the chamber to heat it.

A shelf or a rack (hereinafter, referred to collectively as a "shelf") on which food to be cooked is seated may be installed inside the chamber. In addition, such a shelf may be extractable in a frontward direction of the chamber for a convenience of a user.

In order for the shelf to be extractable in the frontward direction of the chamber, a pair of guides may be installed on opposite sides of the chamber. Each of the guides may include a guide rail which has a length extended in a frontward-rearward direction and is installed on or at a side of the chamber, and a sliding rail which is slidably installed in the guide rail along a lengthwise direction of the guide rail.

As the shelf is mounted in the sliding rail and is moved in the frontward-rearward direction along the sliding rail, a position of the shelf may be changed in the frontward-rearward direction. In addition, the shelf may be mounted in the sliding rail so as to be seated on the sliding rail in a state in which positions according to the frontward-rearward direction of the sliding rails which are each installed on opposite sides of the chamber coincide with each other.

The shelf which is installed as described above to be extracted or retracted by the user directly pulling out the shelf from the chamber or pushing the shelf into the chamber. Therefore, in a state in which the shelf is deeply placed in the chamber, the user has to directly put his hand into the chamber and pull out the shelf. In this case, there is an inconvenience in that the user has to lower his posture and stretch his arms as well as a risk of burns due to a high temperature inside the chamber.

BRIEF DESCRIPTION OF THE DRAWINGS

Embodiments will be described in detail with reference to the following drawings in which like reference numerals refer to like elements, and wherein.

DETAILED DESCRIPTION

Figure 1:
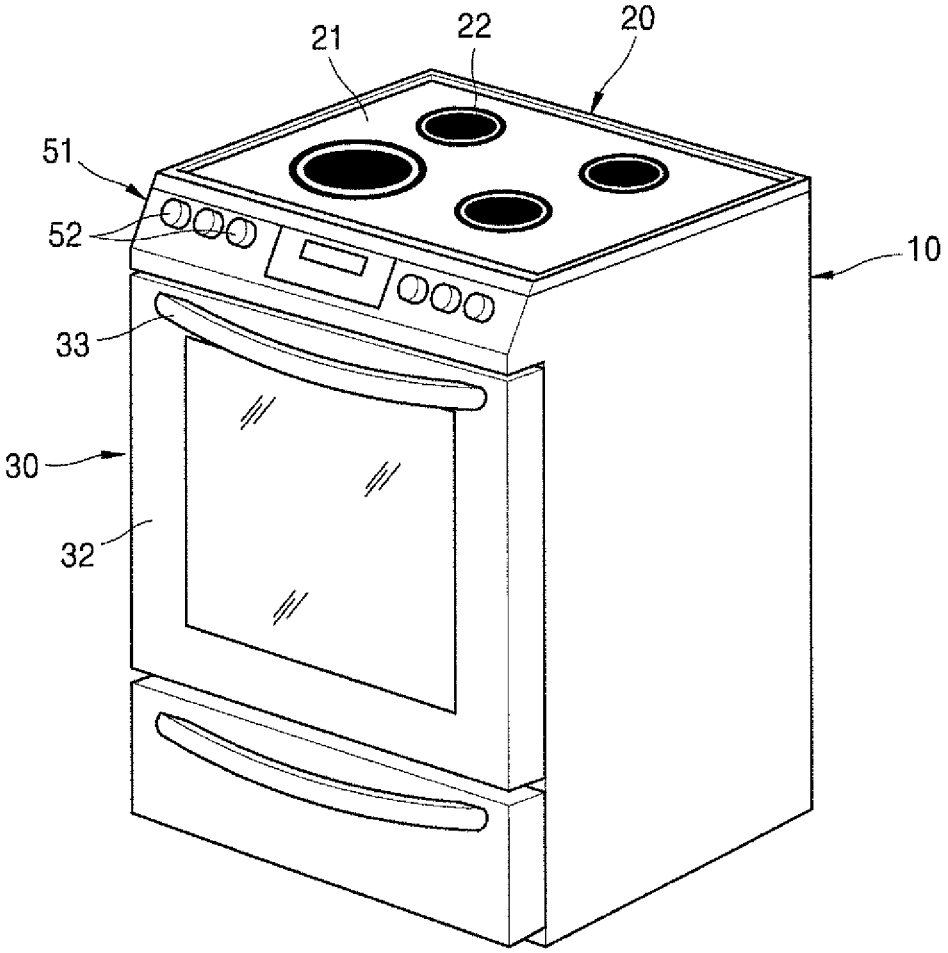
FIG. 1 is a schematic perspective view of a cooking appliance according to an embodiment.

Hereinafter, a shelf supporting apparatus and a cooking appliance including a shelf supporting apparatus according to embodiments will be described with reference to the accompanying drawings. In the drawings, a thickness of lines or a size of elements may be exaggerated and not drawn on scale for the purposes of clarity and convenience. In the following description, the terms or words used in the specification and claims shall not be construed merely in a conventional and dictionary definition but shall be construed in a meaning and concept corresponding to the technical idea based on the principle that an inventor is allowed to properly define the concepts of terms in order to describe his or her invention in the best way. Therefore, the definition of such terminologies should be construed based on the contents throughout the specification.

Figure 2:
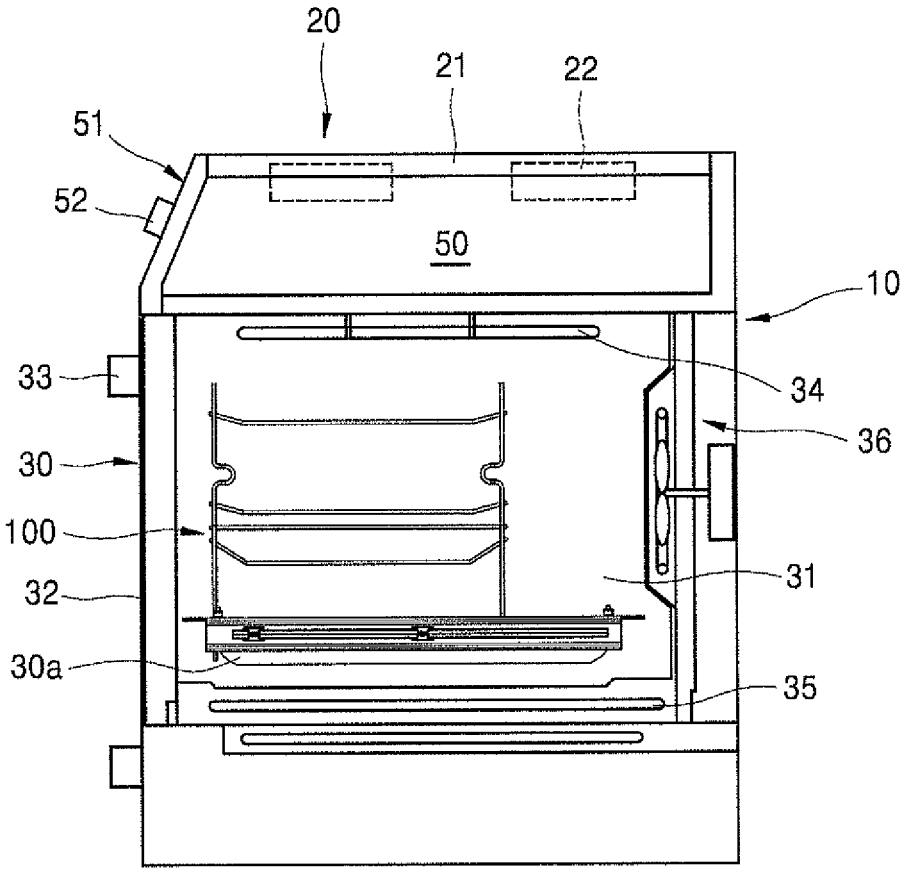
FIG. 2 is a side cross-sectional view illustrating an interior configuration of a cooking appliance according to an embodiment.

FIG. 1 is a perspective view of a cooking appliance according to an embodiment. FIG. 2 is a side cross-sectional view illustrating an interior configuration of a cooking appliance according to an embodiment.

Referring to FIGS. 1 and 2, a shelf supporting apparatus and a cooking appliance including a shelf supporting apparatus according to an embodiment has an appearance formed by a body 10. The body 10 may have an approximately rectangular parallelepiped shape and may be formed of a material having a predetermined strength to protect a plurality of components installed therein.

An open space, that is, a cook top 20 provided to heat food or other items (hereinafter "food") placed thereon or a container containing the food to cook the food may be positioned on an upper end portion of the body 10. The cook top 20 may have a top plate 21 that forms an appearance of an upper surface and supports the food intended to be cooked or a container containing the food. The food intended to be cooked or the container containing the food may be placed on the top plate 21, and one or more heating elements 22 that heat the food intended to be cooked or the container containing the food may be positioned below the top plate 21.

In addition, an oven 30 may be installed below the cook top 20. A chamber 31 that provides a space where the food is cooked may be positioned in an inner space of the oven 30.

A front surface of the chamber 31 may have an open hexahedral shape, and in a state in which such a chamber 31 is closed, the inner space of the chamber 31 may be heated to cook the food. That is, the oven 30 may be a space in which the food is substantially cooked in the inner space of the chamber 31.

An upper heater 34 that heats the inner space of the chamber 31 from above may be provided at an upper side of the chamber 31, and a lower heater 35 that heats the inner space of the chamber 31 may be provided at a lower side of the chamber 31. Further, a convection apparatus 36 that convects hot air to heat the inner space of the chamber 31 may be provided to a rear side of the chamber 31.

The convection apparatus 36 forces air in the inner space of the chamber 31 to flow. That is, the convection apparatus 36 heats the inner space of the chamber 31 by forcing the air to flow while suctioning and heating the air in the inner space of the chamber 31 and then discharging the heated air into the inner space of the chamber 31, thereby uniformly heating the food placed in the inner space of the chamber 31.

The oven 30 may be provided with a door 32 rotatable to selectively open and close the chamber 31. The door 32 may open and close the chamber 31 in a pull-down manner in which an upper end of the door 32 vertically rotates about a lower end of the door 32.

The door 32 may be generally formed in a hexahedral form having a predetermined thickness, and a handle 33 may be installed on a front surface of the door 32 so that the user may grasp the door 32 when the user wants to rotate the door 32. The user may easily rotate the door 32 using the handle 33.

A control panel 51 may be provided on a front surface of the cook top 20, that is, at an upper side of the door 32. The control panel 51 may be formed in a hexahedral form having a predetermined inner space, and an input 52 through which the user may input operating signals that operate the cook top 20 and the oven 30 may be provided on a front surface of the control panel 51.

The input 52 may include a plurality of operation switches through which the user may directly input the operating signals. Further, the control panel 51 may further include a display that provides operation information of the cooking appliance, and cooking information of food, for example, and the user may see various information about the cooking appliance through the display.

An electronic chamber 50 that provides a space in which electronic components may be positioned may be formed in an inner space of the body 10, that is, a space between the cook top 20 and the oven 30. The control panel 51 may be positioned on or at a front surface of the electronic chamber 50, and substantially, a structure in which the control panel 51 closes the front surface of the electronic chamber 50 may be formed.

A shelf 30*a* or a rack to seat the food to be cooked may be provided in the chamber 31. This embodiment will describe a case in which the shelf 30*a* is provided in the chamber 31.

The shelf 30*a* may be removably installed in the chamber 31, and may be provided to be extractable in a frontward direction of the chamber 31 while being vertically position-changeable for the convenience of the user. In order to provide for the shelf 30*a* to be extractable in the frontward direction of the chamber 31 while being vertically position-changeable, a shelf supporting apparatus 100 that supports the shelf 30*a* may be provided inside of the chamber 31.

Figure 3:
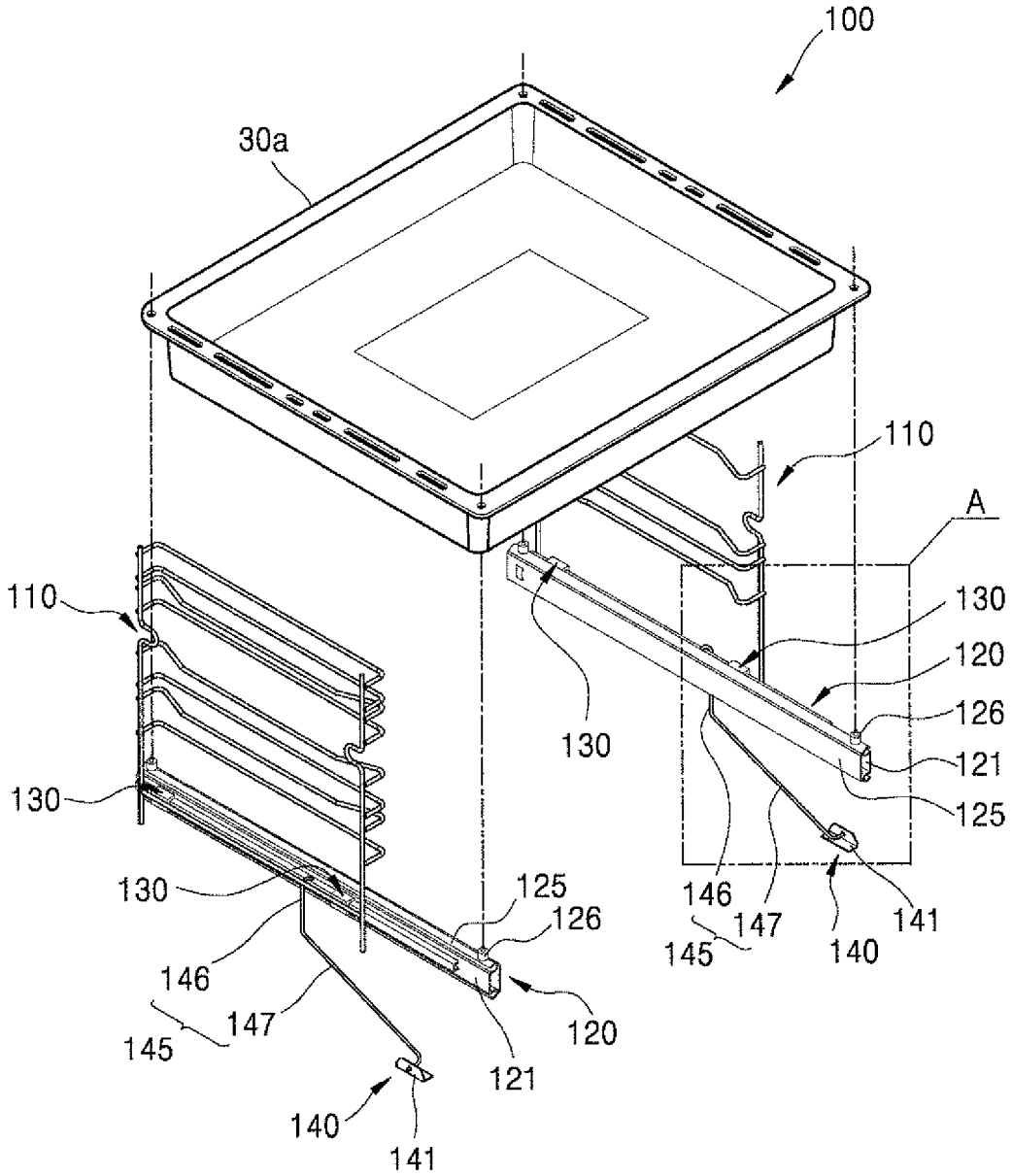
FIG. 3 is a perspective view showing a shelf supporting apparatus according to an embodiment.
Figure 4:
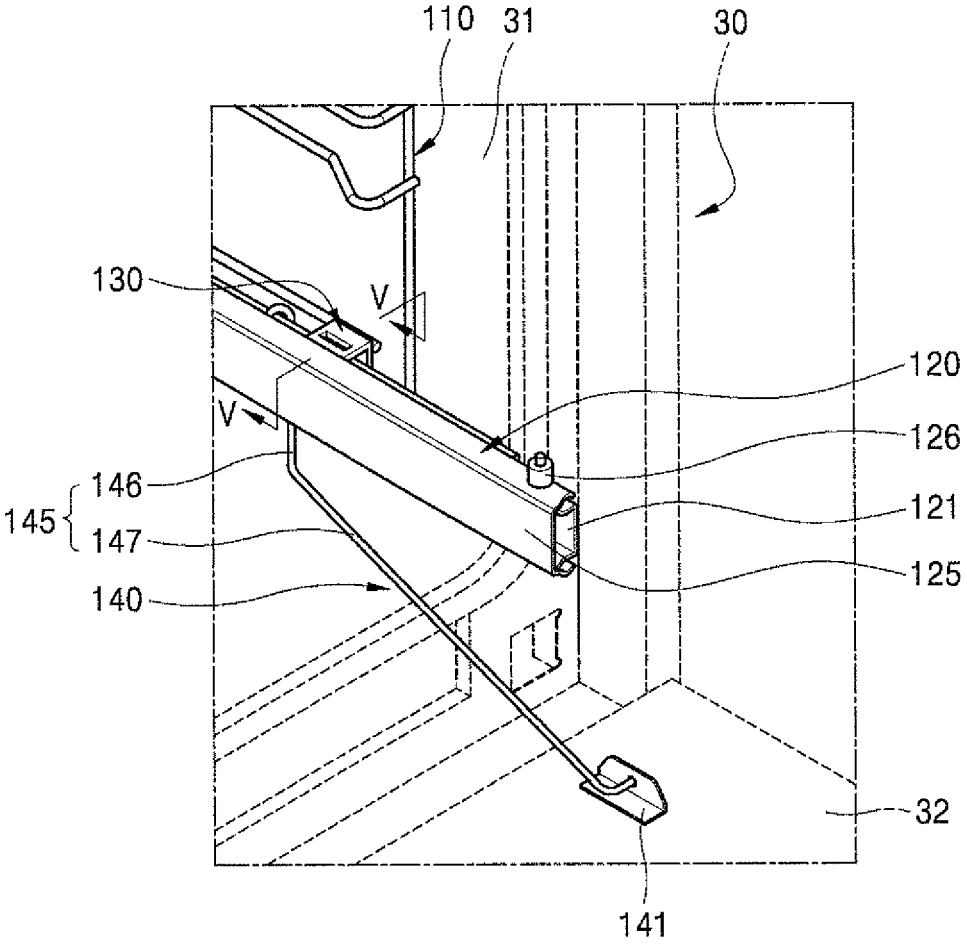
FIG. 4 is an enlarged view of portion A of FIG. 3.
Figure 5:
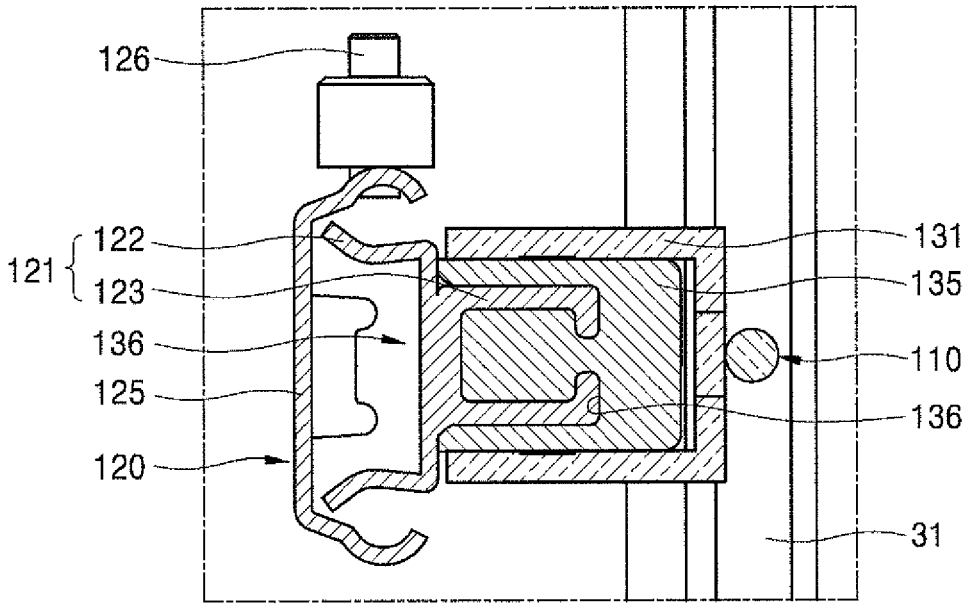
FIG. 5 is a cross-sectional view taken along line V-V of FIG. 4.
Figure 6:
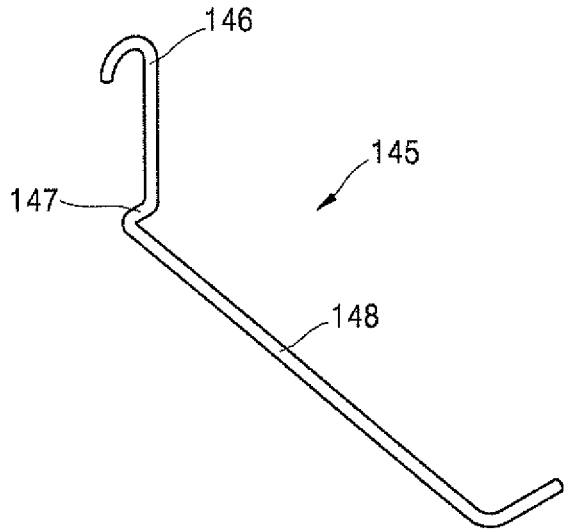
FIG. 6 is a view showing another example of a link shown in FIG. 4.

FIG. 3 is a perspective view showing a shelf supporting apparatus according to an embodiment. FIG. 4 is an enlarged view of portion A of FIG. 3. FIG. 5 is a cross-sectional view taken along line V-V of FIG. 4. FIG. 6 is a view showing another example of a link shown in FIG. 4.

Referring to FIGS. 2 and 3, a shelf supporting apparatus 100 according to an embodiment may include a fixing frame 110, a support 120, a coupling member 130, and a connecting member 140. The fixing frame 110 may be provided to fix the coupling member 130 inside of the chamber 31. According to this embodiment, a pair of fixing frames 110 may be provided inside of the chamber 31 and the pair of fixing frames 110 may be disposed on opposite sides of the chamber 31 to face each other.

Each of the pair of fixing frames 110 may be formed in an appropriately quadrangular shape. According to this embodiment, a plurality of wire rods formed of a metal material is connected to each other to form a quadrangular shaped frame and other wires are connected to the quadrangular shaped frame in a horizontal direction or a vertical direction, thereby forming the pair of fixing frames 110 that supports the quadrangular shaped frame.

Each support 120 may be coupled to a respective fixing frame 110 formed as described above. The respective supports 120 may each be coupled to surfaces, which face each other, of the pair of fixing frames 110 disposed on opposite sides of the chamber 31 to be spaced apart from each other. Coupling between the respective supports 120 and the fixing frames 110 may be performed through coupling member 130, which is described hereinafter. The shelf 30*a* to be supported by the supports 120 may be mounted on a pair of supports 120 coupled to the pair of fixing frames 110.

The respective supports 120 may each be provided to be displaceable in the frontward-rearward direction of the chamber 31. According to this embodiment, the respective supports 120 may include a guide rail 121 and a sliding support 125, as shown in FIGS. 3 to 5.

The guide rail 121 may have a form of a beam having a length which is extended in the frontward-rearward direction thereof. The guide rail 121 may be coupled to the coupling member 130 to be movable in the frontward-rearward direction, so it may be coupled to the fixing frame 110 to be removable and position-changeable.

The guide rail 121 may include a first guide rail 122 and a second guide rail 123. The first guide rail 122 may have a form of a beam having a length which is extended in the frontward-rearward direction thereof and formed in a shape including a cross section of a shape of "]" where a side facing the sliding support 125 is open. The sliding support 125 may be slidably coupled to the first guide rail 122 along a lengthwise direction thereof.

The second guide rail 123 may protrude from the first guide rail 122 so as to be positioned between the fixing frame 110 to which the support 120 is coupled and in which the coupling member 130 may be installed and the first guide rail 122. The second guide rail 123 may be slidably coupled to the coupling member 130 in the frontward-rearward direction thereof, so it corresponds to a portion that couples the support 120 to the coupling member 130 to be movable in the frontward-rearward direction.

According to this embodiment, the first guide rail 122 and the second guide rail 123 may be integrally formed with each other to form the guide rail 121, and the second guide rail 123 may protrude from the first guide rail 122 in a shape of a "C".

The sliding support 125 may have a length which is extended in the frontward-rearward direction, similarly to the guide rail 121, and may be formed in a shape including a cross section of a shape of "[" capable of partially surrounding the guide rail 121 and engaging with the guide rail 121. The sliding support 125 may be slidably installed along a lengthwise direction of the guide rail 121, and a length of the support 120 in the frontward-rearward direction may be changed by a sliding movement of the sliding support 125 in the frontward-rearward direction which is performed along the lengthwise direction of the guide rail 121.

Further, the sliding support 125 may be provided with a mounting protrusion 126 to couple the shelf 30*a* mounted on the support 120 with the support 120. The mounting protrusion 126 may protrude from a top surface of the sliding support 125, and an insertion coupling between the mounting protrusion 126 and a mounting hole (reference numeral not shown) formed in a frame portion of the shelf 30*a* may be implemented. The mounting protrusion 126 may be provided at at least two positions which are spaced apart from each other in the lengthwise direction of the sliding support 125 to stably support the shelf 30.

Each of the supports 120 may be coupled to the fixing frame 110 by the coupling member 130. The coupling member 130 may be included in the fixing frame 110 and couple the support 120 to the fixing frame 110 to be position-changeable in the frontward-rearward direction.

According to this embodiment, the coupling member 130 may include a coupling frame 131 and coupling blocks 135 provided at two or more positions which are spaced apart from each other in a lengthwise direction of the coupling frame 131.

The coupling frame 131 may be formed in a shape including a cross section of a shape of "U". The coupling frame 131 may have an accommodating space formed by bending a metal plate in a shape of "U", where the accommodating space may have one open side. The coupling frame 131 may be installed to be coupled to the fixing frame 110 so that the one open side thereof may be directed toward the support 120.

The coupling block 135 may have a form of a block having a shape corresponding to the accommodating space inside the coupling frame 131 and be installed inside of the coupling frame 131 so as to be positioned in the accommodating space inside of the coupling frame 131. An insertion hole 136 may be formed in the coupling block 135 so as to penetrate through the coupling block 135 in an open form toward the support 120, and the insertion hole 136 may include a shape of a cross section corresponding to the shape of the cross section of the second sliding support 125 formed in the shape of "C".

The guide rail 121 may be insertedly coupled to the coupling block 135 while being engaged with an inner surface of the coupling block 135 through the insertion hole 136. By the coupling structure between the guide rail 121 and the coupling block 135 as described above, the guide rail 121 may be slidable into the coupling block 135 and may be installed so that shaking in remaining directions except for the frontward rearward direction is suppressed. As a result, the guild rail 121 and the support 120 including the same may be coupled to the coupling member 130 in a slidable way and in a stable state in which the shaking is suppressed.

As it is difficult to manufacture the coupling block 135 by bending the metal plate as in the coupling frame 131 due to characteristics of the shape thereof, the coupling block 135 may be formed, for example, in the form of an injection molded plastic component. In addition, the coupling block 135 may be coupled to the coupling frame 131 so as to be fixed inside the coupling frame 131 without the shaking, and the coupling frame 131 may be formed, for example, of a metal material having a high hardness, thereby making it possible to effectively support a load applied to the coupling block 135 and the coupling frame 131.

Although this embodiment illustrates the structure in which the coupling block 135 includes two or more separate blocks, it is also possible to implement the coupling block 135 in a single block form which is extended to be long in the lengthwise direction.

Referring to FIGS. 2 to 4, the connecting member 140 may be connected between the support 120 and the door 32. The connecting member 140 may correspond to a component having a position which is changed in the frontward-rearward direction in conjunction with the rotation of the door 32 and changes the position of the support 120 in the frontward-rearward direction. According to this embodiment, the connecting member 140 may include a bracket 141 and a link 145.

The bracket 141 may be installed on the door 32. The bracket 142 may be provided as a component for coupling the door 32 and the link 145 with each other, and may be installed on the door 32 so as to be coupled to a rear surface of the door 32 facing an inner portion of the chamber 31. According to this embodiment, the bracket 141 may be installed so that a hinge coupling point between the bracket 141 and the link 145 is positioned at a position which is spaced apart by a predetermined distance from a center of rotation of the door 32.

The link 145 may be provided, for example, in a form of a steel wire formed of a metal material that connects between the bracket 141 installed on the door 32 and the support 120. A first side of the link 145 may be coupled to the support 120 so that a coupling point therebetween maintains a fixed position, and a second side of the link 145 may be hinge-coupled to the bracket 141.

When the door 32 rotates in a direction in which the chamber 31 is opened, the link 145 installed as described above moves along the door 32 to move the support 120 in a direction toward an outside of the chamber 31. Further, when the door 32 rotates in a direction in which the chamber 31 is closed, the link 145 moves along the door 32 to move the support 120 in a direction toward an inside of the chamber 31. In addition, the shelf 30*a* mounted on the support 120 may move in the direction toward the outside of the chamber 31 or move toward the inside of the chamber 31 along the support 120 which is moved in the frontward-rearward direction by the link 145 which is in conjunction with the opening and closing of the door 32.

According to this embodiment, the link 145 may include a first link 146 and a second link 147. The first link 146 may correspond to a portion of the link 145 which is coupled to the support 120. According to this embodiment, a coupled point between the link 145 and the support 120 may be positioned inside of the chamber 31. This is to suppress the link 145, which is the component for automatically extracting the support 120 and the shelf 30*a* mounted thereon, from being exposed to the outside of the cooking appliance and to suppress the operation of the link 145 from being exposed to the outside of the cooking appliance.

The first link 146 may have a first side coupled to the support 120 and a second side which downwardly extends to a bottom surface of the chamber 31 so that the coupled point between the link 145 and the support 120 may be positioned inside of the chamber 31. In addition, the second link 147 may extend to the door 32 from the second side of the first link 146 which downwardly extends to the bottom surface of the chamber 31. A first side of the second link 147 may be connected to the second side of the first link 146, and a second side of the second link 147 may be rotatably hinge-coupled to the bracket 141. The first link 146 and the second link 147 may be connected with each other while forming a shape of an "L" and be connected with each other while forming an obtuse angle with each other, and the first link 146 and the second link 147 which are connected in such a form may form the link 146.

According to this embodiment, the door 32 may be installed on a front surface of the body 10 so as to open and close the chamber 31 in the pull-down manner in which the upper end of the door 32 vertically rotates about the lower end of the door 32. That is, a rotational center of the door 32 may be positioned at a lower portion of the front surface of the body 10. In addition, the first link 146 may have a length so that the second link 147 does not interfere with the bottom surface of the chamber 31 and may be positioned at a position which is closest to the rotational center of the door 32. Also, the second link 147 does not interfere with the bottom surface of the chamber 31 and connects between the first link 146 and the door 32 at the position which is closest to the rotational center of the door 32. Accordingly, the link 145 associates a rotational operation of the door 32 with an inserting and extracting operation of the shelf 30*a* in a state in which it is installed so as not to be exposed to the outside of the cooking appliance.

The connecting member 140 including the configuration as described above changes the position of the support 120 so that at least a portion of the shelf 30*a* protrudes to the outside of the chamber 31 when the door 32 opens the chamber 31, and changes the position of the supporting member 120 so that the shelf 30*a* is inserted into the chamber 31 when the door 32 closes the chamber 31. According to the connecting member 140 configured as described above, the position of the bracket 141 in a vertical direction when the door 32 closes the chamber 31 and the position of the bracket 141 in the vertical direction when the door 32 opens the chamber 31 may be different from each other. In other words, during the opening or closing of the door 32, the position of the bracket 141 is not only changed in the frontward-rearward direction but also in the vertical direction, and a phenomenon that a bending moment is applied to the link 145 during the opening or closing of the door 32 may occur by the change in the position of the bracket 141 in the vertical direction.

According to this embodiment, a first side of the first link 146 may be coupled to the support 120 and be insertedly coupled to art upper surface of the guide rail 121. The first side of the first link 146 may be formed in a hook shape in which an end portion thereof is directed downwardly, and a link inserting hole may be formed in an upper surface of the guide rail 121 so as to penetrate through the upper surface in a vertical direction. The first side of the first link 146 may be insertedly coupled to the guide rail 121 through the link inserting hole formed in the upper surface of the guide rail 121, and the connecting member 140 and the support 120 may be coupled to each other by the insertion coupling between the first link 146 and the guide rail 121 as described above.

The coupled portion between the first link 146 and the guide rail 121 as described above may be provided as a portion capable of absorbing a bending moment applied to the link 145. In other words, as the first link 146 is not perfectly engaged with the guide rail 121 and is loosely coupled to the guide rail 121 to penetrate through the upper surface of the guide rail 121, the first link 146 is in a state in which it is coupled to guide rail 121 so that a certain tilt change is possible. As a result, when the bending moment is applied to the link 145, the first link 146 may have the tilt which is changed accordingly and absorb an influence of the bending moment applied to the link 145. Accordingly, even though the bending moment is applied to the link 145 during the opening or closing of the door 32, it is possible to provide high operation stability while effectively blocking the influence caused by the bending moment from being transferred to other components coupled to the link 145.

As another example, the link 145 may be provided in a form where a third link 148 connects between the first link 146 and the second link 147. The third link 148 may extend in a horizontal direction from the second side of the first link 146 extended downwardly to the bottom surface of the chamber 31, for example, in a lateral direction from the side of the chamber 31 to a center of the chamber 31. In other words, as compared to the case in which the first link 146 is extended vertically and the second link 147 is extended in the frontward-rearward direction, the third link 148 may extend in a lateral direction.

In addition, as the first side of the second link 147 is connected to a second side of the third link 148 connected to the first link 146, the second link 147 may be connected to the first link 146 through the third link 148. The third link 148 connecting between the first link 146 and the second link 147 as described above positions the second link 147 that needs to be connected to the first link 146 installed to be adjacent to a side of the chamber 31 to be coupled to the guide rail 121 installed to be adjacent to the side of the chamber 31 at a position which is further spaced apart from the side of the chamber 31, thereby making it possible for the second link 146 to be freely positioned at the position which does not interfering with the side of the chamber 31 and components mounted around the side of the chamber 31.

Further, the third link 148 may also serve as a torsional deformation point for absorbing influence of the bending moment between the first link 146 and the second link 147. That is, the third link 148 may form a connection axis which is in parallel to a rotational axis of the bending moment applied to the link 145 between the first link 146 and the second link 147, thereby absorbing the influence of the bending moment applied to the link 145 while being torsionally deformed according to the bending moment when the bending moment is applied to the link 145.

As still another example, instead of the form where the third link 148 connects between the first link 146 and the second link 147, the link 145 may also be provided in a form where the first link 146 and the second link 147 are hinge-coupled to each other to be rotatable in the frontward-rearward direction. As still another example, the link 145 may also be provided in a form where one side of the first link 146 is hinge-coupled to the upper surface of the guide rail 121 so as to be rotatable in the frontward-rearward direction.

Figure 7:
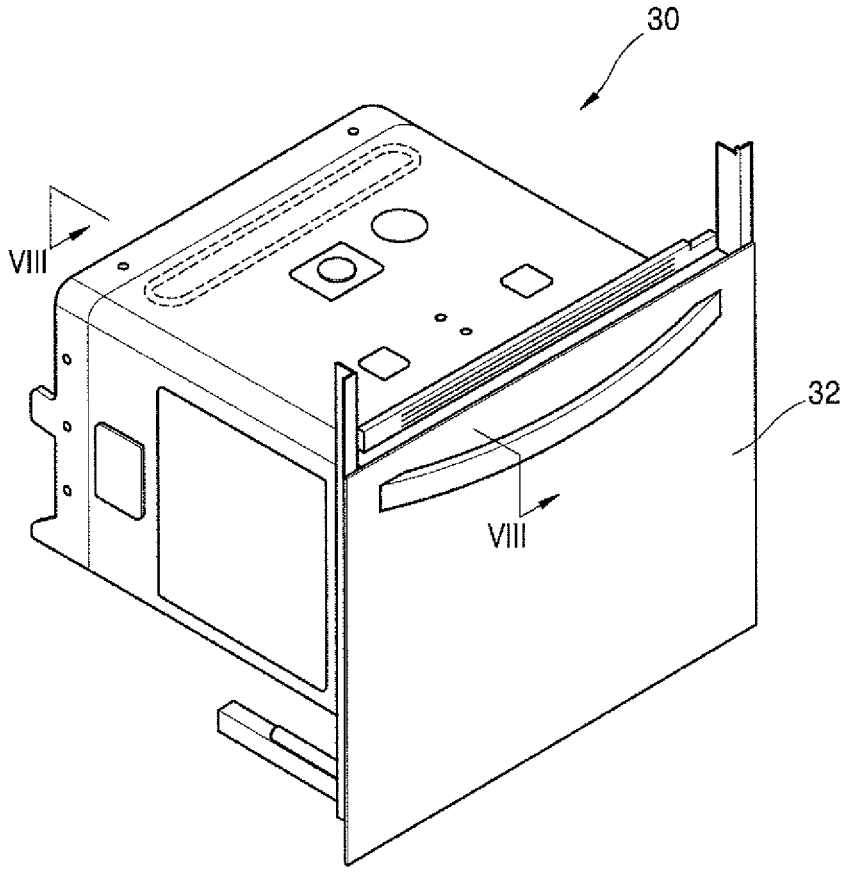
FIG. 7 is a perspective view showing a closed state of a door of the cooking appliance, which shows some components of the cooking appliance according to an embodiment.
Figure 8:
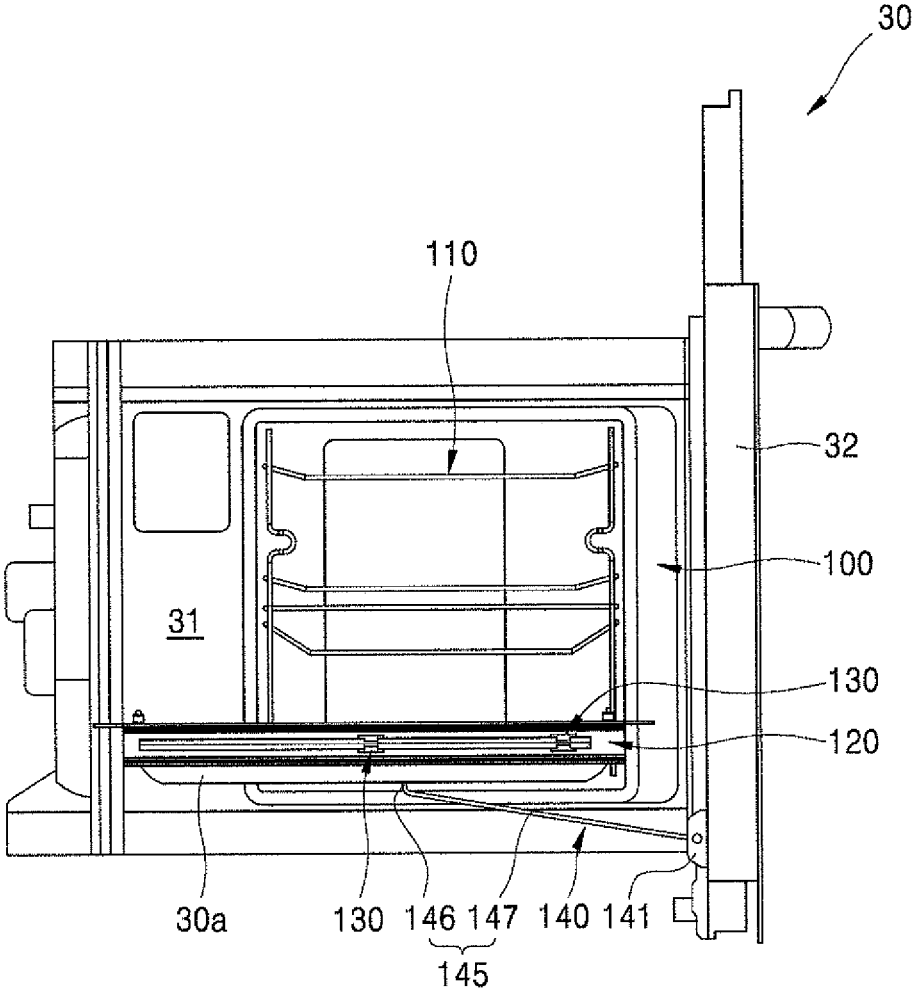
FIG. 8 is a cross-sectional view taken along line VIII-VIII of FIG. 7.
Figure 9:
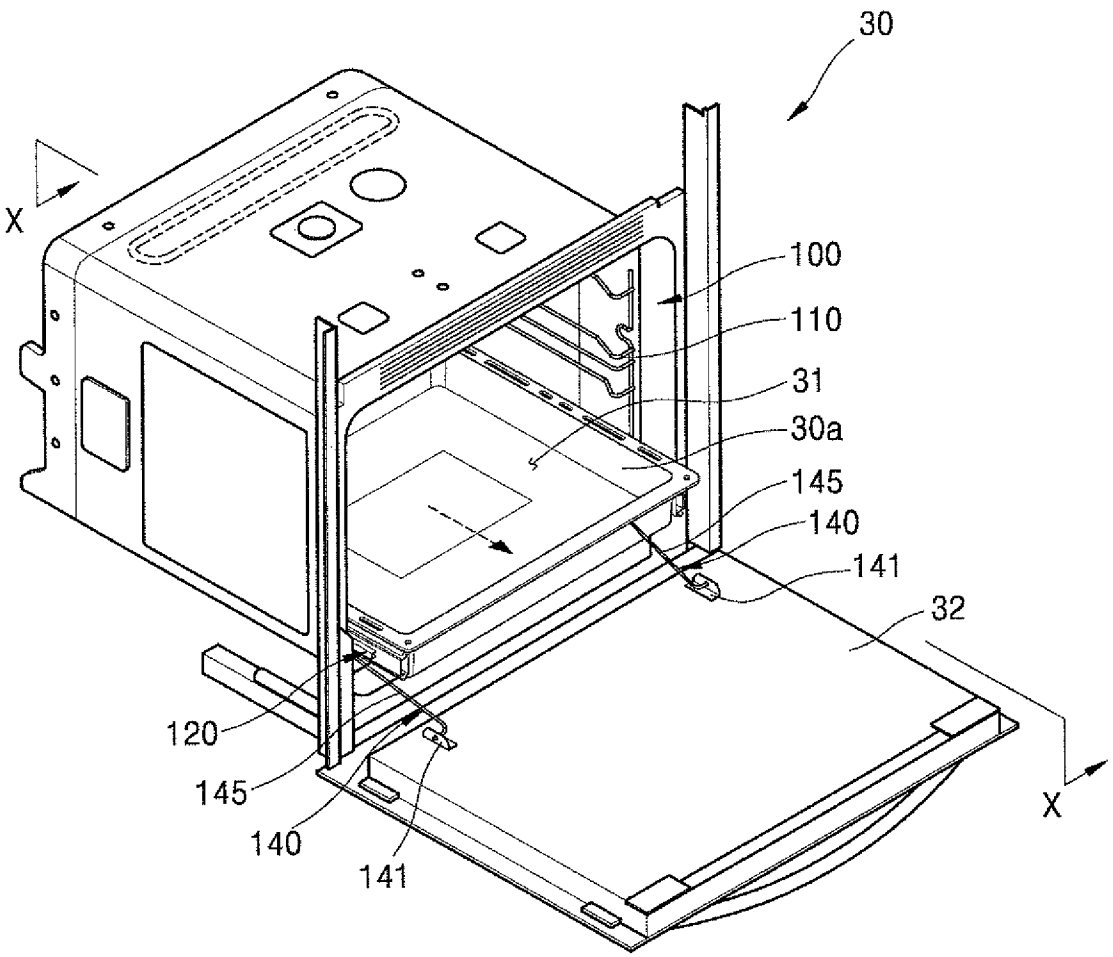
FIG. 9 is a perspective view showing an opened state of the door of the cooking appliance shown in FIG. 7.
Figure 10:
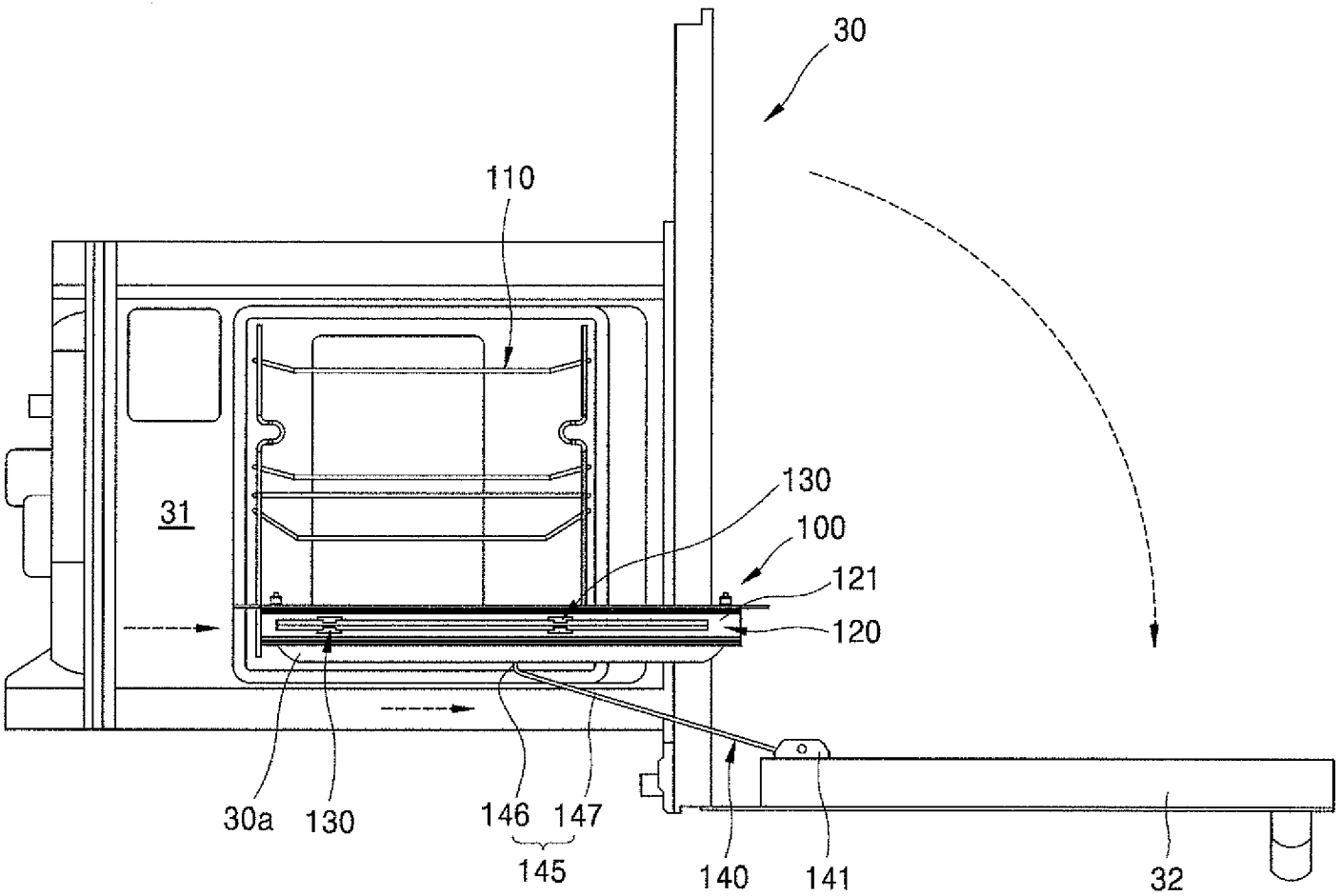
FIG. 10 is a cross-sectional view taken along line X-X of FIG. 9.
Figure 11:
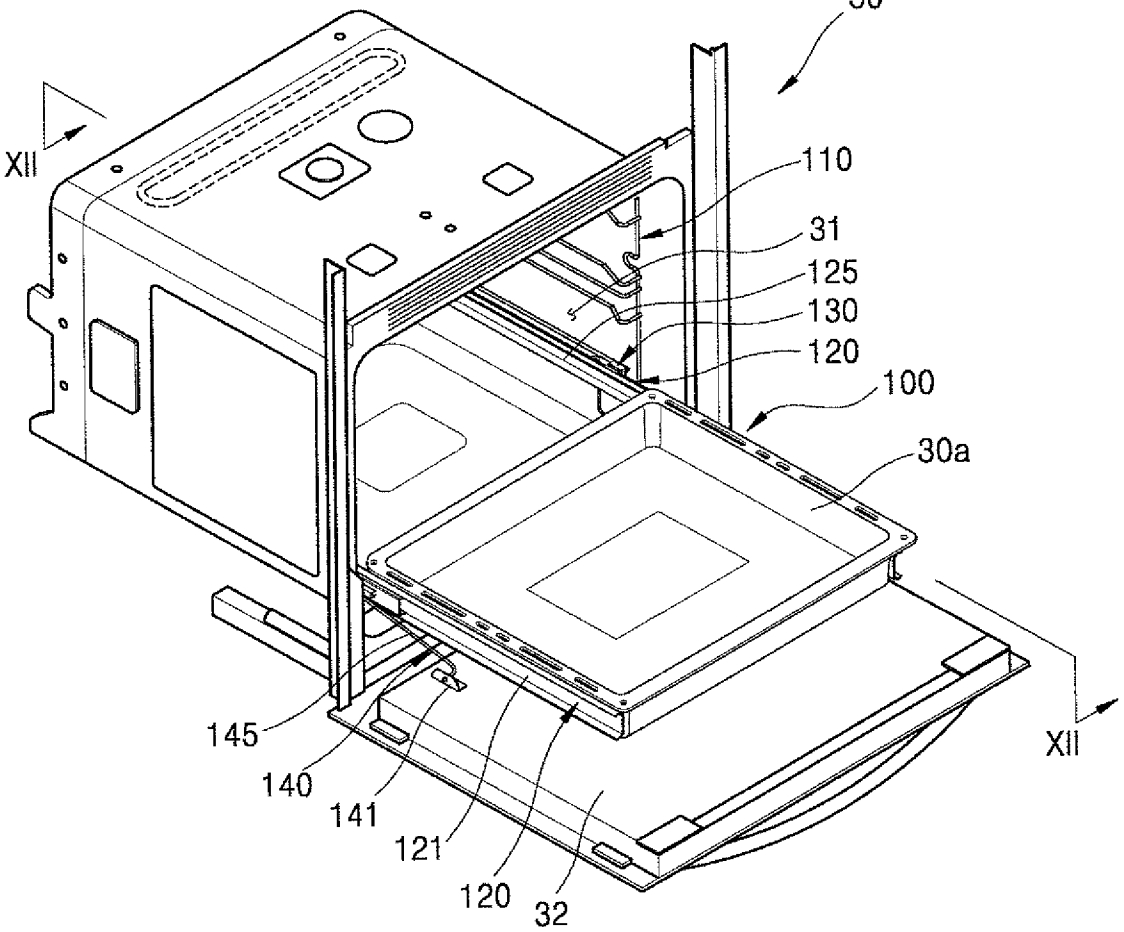
FIG. 11 is a perspective view showing an extracted state of the shelf of the cooking appliance shown in FIG. 9.
Figure 12:
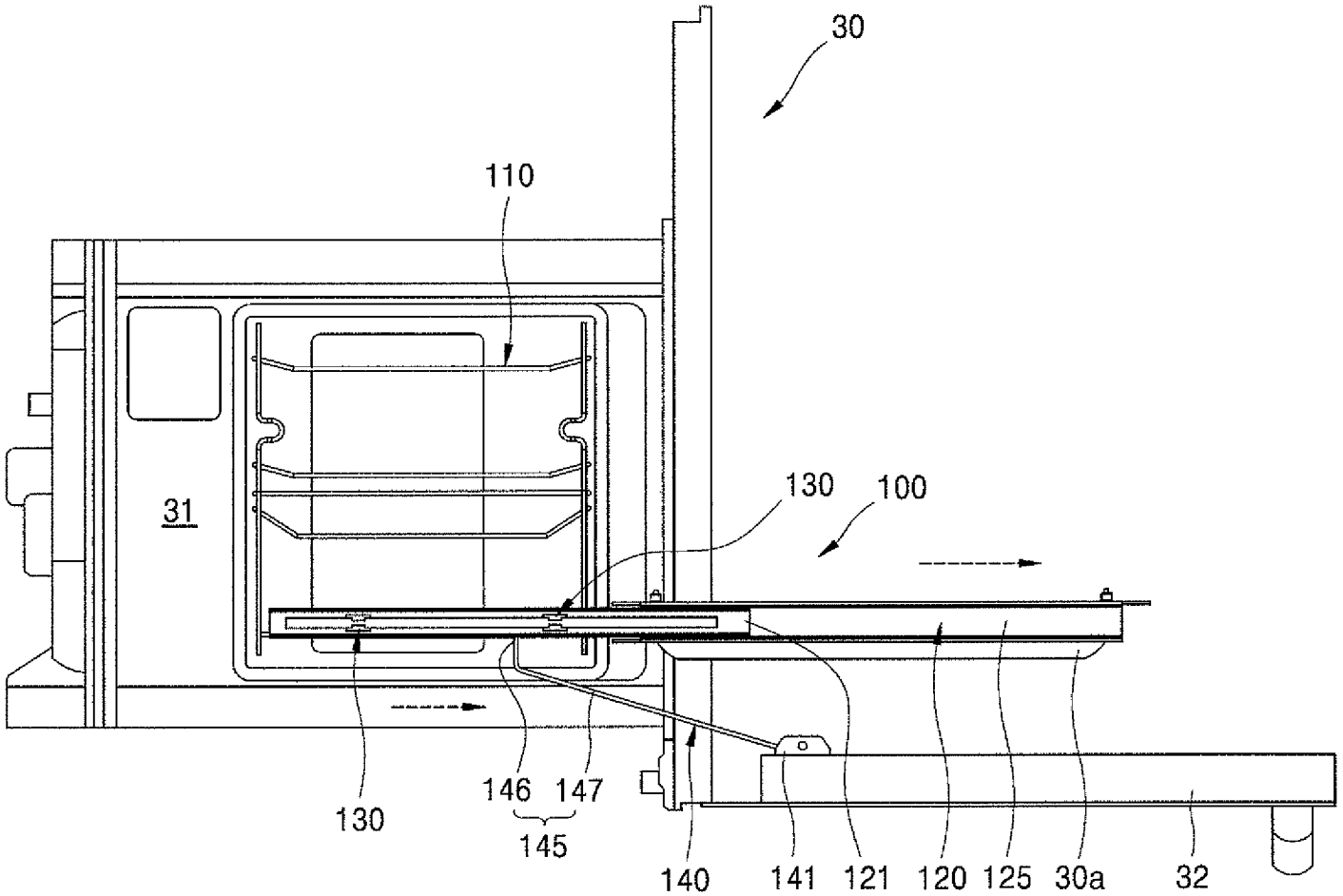
FIG. 12 is a cross-sectional view taken along line XII-XII of FIG. 11.

FIG. 7 is a perspective view showing a closed state of a door of the cooking appliance, which shows some components of the cooking appliance according to an embodiment. FIG. 8 is a cross-sectional view taken along line VIII-VIII of FIG. 7. FIG. 9 is a perspective view showing an opened state of the door of the cooking appliance shown in FIG. 7. FIG. 10 is a cross-sectional view taken along line X-X of FIG. 9. FIG. 11 is a perspective view showing an extracted state of the shelf of the cooking appliance shown in FIG. 9. FIG. 12 is a cross-sectional view taken along line XII-XII of FIG. 11.

Hereinafter, operations and effects of the shelf supporting apparatus 100 and the cooking appliance therewith according to an embodiment will be described with reference to FIGS. 7 to 12.

Referring to FIGS. 7 and 8, the pair of fixing frames 110 may be installed inside the chamber 31, and the pair of fixing frames 110 may be disposed on opposite sides of the chamber 31 to face each other so as to be positioned at positions which are adjacent to the respective sides of the chamber 31. The support 120 may each be installed in the respective fixing frames 110 as described above. The support 120 may be coupled to the fixing frame 110 to be movable in the frontward-rearward direction by a slidable coupling with the coupling member 130 installed in the fixing frame 110. In addition, each support 120 may have a length which is changed in the frontward-rearward direction by movement in the frontward-rearward direction of the sliding support 125 which is slidably coupled to the guide rail 121.

The shelf 30*a* may be mounted on the pair of supports 120 which is each installed in the pair of fixing frames 110. The shelf 30*a* mounted on the support 120 may be installed in the chamber 31 to be extractable in the frontward-rearward direction and may be installed so that an entirety of the shelf 30*a* may be positioned in the inner space of the chamber 31 closed by the door 32 in a state in which the door 32 closes the chamber 31.

Further, the support 120 installed as described above may be connected to the door 32 by the connecting member 140. The connecting member 140 corresponds to a component having a position which is changed in the frontward-rearward direction in conjunction with rotation of the door 32 and changes the position of the support 120 in the frontward-rearward direction.

In this state, as shown in FIGS. 9 and 10, when the door is rotated to open the inside of the chamber 31, the inside of the chamber 31 is opened toward the front of the cooking appliance and the connecting member 140 which was connected to the door 32 is moved along the door 32. In addition, the support 120 connected to the connecting member 140 is also moved along the connecting member 140.

The link 145 of the connecting member 140 is connected to the guide rail 121 of the support 120, the guide rail 121 connected to the link 145 as described above is forwardly moved along the link 145, and an entirety of the support 120 is moved in a direction in which it is extracted forwardly along the connecting member 140, accordingly. As a result, the shelf 30*a* mounted on the support 120 is extracted forwardly along the support 120, where the shelf 30*a* is extracted such that a front portion of the shelf 30*a* protrudes outside of the chamber 31. That is, when the inside of the chamber 31 is opened by rotating the door 32, the position of the shelf 30*a* is changed to a state in which the user may grip and extract the shelf 30*a* at the outside of the chamber 31 without directly putting his hand into the chamber 31 and pulling out the shelf 30*a*.

The change in the position of the shelf 30*a* is not by the change in length of the support 120, that is, movement of the sliding support 125, but is by the change in position of the support 120 itself which is extracted by the connecting member 140, that is, movement of the guide rail 121. Further, the connecting member 140 which acts to change positions of the support 120 and the shelf 30*a* is coupled to the support 120 so that the coupled point between the link 145 of the connecting member 140 and the support 120 is positioned inside of the chamber 31, that is, the coupled portion between the connecting member 140 and the support 120 is positioned at the position which is not exposed to the outside of the chamber 31.

In addition, the connecting member 140 is installed to be positioned at a portion which is adjacent to the rotational center of the door 32 so that the link 145 does not interfere with the lower portion of the cooking appliance, that is, the bottom surface of the chamber 31. That is, the connecting member 140 associates the rotational operation of the door 32 with an inserting and extracting operation of the shelf 30*a* in a state in which it is installed so as not to be exposed to the outside of the cooking appliance.

As described above, in the state in which the front portion of the shelf 30*a* of protrudes outside of the chamber 31, when the user grips the protruded portion of the shelf 30*a* and pulls out the shelf 30*a* toward the front of the chamber 31, the length of the support 120 may be changed as shown in FIGS. 11 and 12.

In the state in which the shelf 30*a* is mounted on the supports 120, when user pulls out the shelf 30*a* toward the front of the chamber 31, the lengths of the pair of supports 120 are together elongated along the shelf 30*a* extracted toward the front of the chamber 31, thereby making it possible to guide extraction of the shelf 30*a*. The length of the support 120 is changed by slide-moving the sliding support 125 which is slidably coupled to the guide rail 121 along a passage formed in the lengthwise direction of the guide rail 121.

In other words, according to the cooking appliance according to this embodiment, in the state in which the inside of the chamber 31 is closed by the door 32, the shelf 30*a* positioned inside of the chamber 31 may be extracted so that the front portion protrudes outside of the chamber 31 by the support 120 which is moved in conjunction with the operation of the door 32 which is moved to open the chamber 31, and in this state, when the user grips the protruded portion of the shelf 30*a* with his or her hand and pulls out the shelf 30*a* toward the front of the chamber 31, most of the region of the shelf 30*a* may be extracted to be positioned outside the chamber 31 while extraction thereof is guided by the support 120 the length of which is elongated.

As described above, the door 32 and the cooking appliance therewith according to this embodiment may provide a function of automatically changing the position of the shelf 30*a* in a state in which the user may grip and extract the shelf 30*a* in the outside of the chamber 31 when the door 32 is opened. The door 32 and the cooking appliance including the door according to this embodiment reduces inconvenience that the user has to lower his posture and stretch his arms into the chamber 31 during extraction of the shelf 30*a* and lowers the risk of burns due to the high temperature inside of the chamber 31, thereby making it possible to provide improved usability and stability. Further, according to the door 32 and the cooking appliance therewith according to this embodiment, as components, such as the connecting member 140 for extracting the shelf 30*a* in conjunction with the rotation of the door 32, are installed and operated so as not to be exposed to the outside, it is possible to provide improved usability and stability and to provide smooth and simple appearance aesthetics As set forth above, the shelf supporting apparatus and the cooking appliance including the shelf supporting apparatus according to embodiments disclosed herein may provide a function of automatically changing a position of a shelf in a state in which a user may extract the shelf while grasping the shelf outside of the chamber in the case of opening the door. The door and the cooking appliance including the door according to embodiments disclosed herein reduces inconvenience that the user has to lower his posture and stretch his arms into the chamber during extraction of the shelf and lowers the risk of burns due to the high temperature inside of the chamber, thereby making it possible to provide improved usability and stability.

Further, according to embodiments disclosed herein, as components such as the connecting member for extracting the shelf in conjunction with the rotation of the door, are installed and operated so as not to be exposed to the outside of the chamber, it is possible to provide improved usability and stability and to provide smooth and simple appearance aesthetics.

Embodiments disclosed herein provide a shelf supporting apparatus having an improved structure to improve usability and stability of a user who uses the shelf, and a cooking appliance including a shelf supporting apparatus.

Embodiments disclosed herein provide a shelf supporting apparatus that may include a pair of fixing frames provided to face each other on opposite sides of a chamber which is opened and closed by a door; a pair of supporting members or supports provided to have a length which is changeable in a frontward-rearward direction to be each coupled to the fixing frames and having a shelf mounted thereon; coupling members provided on the fixing frames and coupling the supporting members to the fixing frames to be position-changeable in the frontward-rearward direction; and a connecting member that connects between the supporting members and the door, having a position which is changed in the frontward-rearward direction in conjunction with a rotation of the door, and changing positions of the supporting members in the frontward-rearward direction. The connecting member may include a bracket part or bracket installed on the door, and a link part or link having one or a first side coupled to the supporting member and the other or a second side hinge-coupled to the bracket part.

The bracket part may be installed on the door so that the hinge-coupled portion between the bracket part and the link part is positioned at a point which is spaced apart from a rotational center of the door by a predetermined distance. The link part may move along the door when the door is rotated in a direction in which the chamber is opened and moves the supporting member in a direction toward an outside of the chamber, and move along the door when the door is rotated in a direction in which the chamber is closed and move the supporting member in a direction toward an inside of the chamber.

The supporting member may include a guide rail part or rail having a length extended in the frontward-rearward direction, installed on the coupling member to be movable in the frontward-rearward direction, and coupled to the connecting member to be moved in the frontward-rearward direction along the connecting member, and a sliding supporting part or support slidably installed along a lengthwise direction of the guide rail part and having a shelf mounted thereon. An end portion or end of one side of the first link part may have a hook shape in which the end portion is directed downwardly, a link inserting hole may be formed in an upper surface of the guide rail part so as to penetrate through the upper surface in a vertical direction, and the one side of the first link part may be insertedly coupled to the guide rail part through the link inserting hole so that the insertion coupling between the first link part and the guide rail part is made.

Embodiments disclosed herein provide a cooking appliance that may include a body in which a chamber is formed; a door rotatably installed on the body to open and close the chamber; a shelf provided to be installed in the chamber; and a shelf supporting apparatus provided in the chamber to support the shelf. The shelf supporting apparatus may include a pair of fixing frames provided to face each other on opposite sides of the chamber; a pair of supporting members or supports provided to have a length which is changeable in a frontward-rearward direction to be each coupled to the fixing frames and having the shelf mounted thereon; coupling members provided on the fixing frames and coupling the supporting members to the fixing frames to be position-changeable in the frontward-rearward direction; and a connecting member that connects between the supporting members and the door, having a position which is changed in the frontward-rearward direction in conjunction with a rotation of the door, and changing positions of the supporting members in the frontward-rearward direction.

The connecting member may include a bracket part or bracket installed on the door, and a link part or link having one or a first side coupled to the supporting member and the other or a second side hinge-coupled to the bracket part. The link part may be installed so that a coupled point between the link part and the supporting member is positioned inside the chamber.

The link part may include a first link part or link having one or a first side coupled to the supporting member and the other or a second side extended downwardly toward a bottom surface of the chamber so that a coupled point between the link part and the supporting member is positioned inside the chamber; and a second link part or link extended from the other side of the first link part to the door and rotatably coupled to the bracket part. The first link part and the second link part may be connected with each other while forming a shape of "L" and may be connected with each other while forming an obtuse angle to form the link part. The first link part may have a length that the second link part is positioned at a position which is closest a rotational center of the door while not interfering with a bottom surface of the chamber.

The connecting member may change positions of the supporting members so that at least a portion of the shelf protrudes to the outside of the chamber when the door opens the chamber, and change positions of the supporting members so that the shelf is inserted into the chamber when the door closes the chamber.

Although embodiments have been described with reference to the accompanying drawings, these are merely illustrative. It will be appreciated by those skilled in the art that various modifications and equivalents are possible without departing from the scope. Accordingly, the true scope sought to be protected is defined solely by the claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A shelf supporting apparatus for supporting a shelf installed in a chamber, the shelf supporting apparatus comprising:

a pair of fixing frames provided to face each other on opposite sides of the chamber, which is opened and closed by a door;

a pair of supports provided to have a length which is changeable in a frontward-rearward direction, the pair of supports being, respectively, coupled to the pair of fixing frames and having the shelf mounted thereon;

coupling members provided on the pair of fixing frames and coupling the pair of supports to the pair of fixing frames to be position-changeable in the frontward-rearward direction; and a pair of connecting members that, respectively, connects the pair of supports and the door, having a position which is changed in the frontward-rearward direction in conjunction with a rotation of the door, and changing positions of the pair of supports in the frontward-rearward direction, wherein the pair of connecting members each includes:

a bracket installed on the door; and a link having a first side coupled to a respective support of the pair of supports and a second side hinge-coupled to the bracket, wherein each bracket is installed on the door so that a hinge-coupled portion between the bracket and the link is positioned at a point which is spaced apart from a rotational center of the door by a predetermined distance, and wherein the link moves along the door when the door is rotated in a direction in which the chamber is opened and moves the support in a direction toward an outside of the chamber, and moves along the door when the door is rotated in a direction in which the chamber is closed and moves the support in a direction toward an inside of the chamber.

2. The shelf supporting apparatus of claim 1, wherein the link includes:

a first link having a first side coupled to the support and a second side that extends downwardly toward a bottom surface of the chamber so that a coupled point between the link and the support is positioned inside of the chamber; and a second link that extends from a second side of the first link to the door and rotatably coupled to the bracket.

3. The shelf supporting apparatus of claim 2, wherein the first link and the second link are connected with each other while forming a shape of an "L" and are connected with each other while forming an obtuse angle to form the link.

4. The shelf supporting apparatus of claim 2, wherein the support includes:

a guide rail having a length extended in the frontward-rearward direction, installed on the coupling member to be movable in the frontward-rearward direction, and coupled to the connecting member to be moved in the frontward-rearward direction along the connecting member; and a sliding support slidably installed along a lengthwise direction of the guide rail and having the shelf mounted thereon.

5. The shelf supporting apparatus of claim 4, wherein an end portion of a first side of the first link has a hook shape in which the end portion is directed downwardly, wherein a link inserting hole is formed in an upper surface of the guide rail so as to penetrate through the upper surface in a vertical direction, and wherein the first side of the first link is insertedly coupled to the guide rail through the link inserting hole so that an insertion coupling between the first link and the guide rail is made.

6. A cooking appliance including the shelf supporting apparatus of claim 1.

7. A cooking appliance for cooking food, the cooking appliance comprising:

a body in which a chamber is formed;

a door rotatably installed on the body to open and close the chamber;

a shelf provided to be installed in the chamber; and a shelf supporting apparatus provided in the chamber to support the shelf, wherein the shelf supporting apparatus includes:

a pair of fixing frames provided to face each other on opposite sides of the chamber;

a pair of supports provided to have a length which is changeable in a frontward-rearward direction, the pair of supports being, respectively, coupled to the pair of fixing frames and having the shelf mounted thereon;

coupling members provided on the pair of fixing frames and coupling the pair of supports to the fixing frames to be position-changeable in the frontward-rearward direction; and a pair of connecting members that, respectively, connects the pair of supports and the door, having a position which is changed in the frontward-rearward direction in conjunction with a rotation of the door, and changing positions of the pair of supports in the frontward-rearward direction, and wherein the pair of connecting members each includes:

a bracket installed on the door; and a link having a first side coupled to a respective support of the pair of supports and a second side hinge-coupled to the bracket.

8. The cooking appliance of claim 7, wherein the link is installed so that the coupled point between the link and the support is positioned inside the chamber.

9. The cooking appliance of claim 7, wherein the link includes:

a first link having a first side coupled to the support and a second side that extends downwardly toward a bottom surface of the chamber so that a coupled point between the link and the support is positioned inside of the chamber; and a second link that extends from a second side of the first link to the door and rotatably coupled to the bracket.

10. The cooking appliance of claim 9, wherein the first link and the second link are connected with each other while forming a shape of an "L" and are connected with each other while forming an obtuse angle to form the link.

11. The cooking appliance of claim 9, wherein the first link has a length such that the second link is positioned at a position which is closest to a rotational center of the door while not interfering with a bottom surface of the chamber.

12. The cooking appliance of claim 7, wherein the pair of connecting members changes positions of the pair of supports so that at least a portion of the shelf protrudes to an outside of the chamber when the door opens the chamber, and changes the positions of the pair of supports so that the shelf is inserted into the chamber when the door closes the chamber.

13. A shelf supporting apparatus for supporting a shelf installed in a chamber, the shelf supporting apparatus comprising:

a pair of fixing frames provided to face each other on opposite sides of the chamber, which is opened and closed by a door;

a pair of supports provided to have a length which is changeable in a frontward-rearward direction, the pair of supports being, respectively, coupled to the pair of fixing frames and having the shelf mounted thereon;

coupling members provided on the pair of fixing frames and coupling the pair of supports to the pair of fixing frames to be position-changeable in the frontward-rearward direction; and a pair of connecting members that, respectively, connects the pair of supports and the door, having a position which is changed in the frontward-rearward direction in conjunction with a rotation of the door, and changing positions of the pair of supports in the frontward-rearward direction, wherein the pair of connecting members each includes:

a bracket installed on the door; and a link coupled to a respective support of the pair of supports and hinge-coupled to the bracket, wherein the pair of connecting members changes positions of the pair of supports so that at least a portion of the shelf protrudes to an outside of the chamber when the door opens the chamber, and changes the positions of the pair of supports so that the shelf is inserted into the chamber when the door closes the chamber, wherein each bracket is installed on the door so that a hinge-coupled portion between the bracket and the link is positioned at a point which is spaced apart from a rotational center of the door by a predetermined distance.

14. The shelf supporting apparatus of claim 13, wherein the link moves along the door when the door is rotated in a direction in which the chamber is opened and moves the support in a direction toward an outside of the chamber, and moves along the door when the door is rotated in a direction in which the chamber is closed and moves the support in a direction toward an inside of the chamber.

15. A cooking appliance including the shelf supporting apparatus of claim 13.

* * * * *